United States Patent [19]

Matsushita et al.

[11] 4,312,422

[45] Jan. 26, 1982

[54] EXHAUST SILENCER FOR OUTBOARD ENGINE WITH A REFLECTION CHAMBER

[75] Inventors: Yukio Matsushita, Iwata; Takehisa Suzuki, Shizuoka, both of Japan

[73] Assignees: Yamaha Hatsudoki Kabushiki Kaisha, Iwata; Sanshin Kogyo Kabushiki Kaisha, Hamamatsu, both of Japan

[21] Appl. No.: 154,772

[22] Filed: May 30, 1980

[30] Foreign Application Priority Data

Jun. 8, 1979 [JP] Japan ..... 54-72004

[51] Int. Cl.[3] ..... F01N 1/08; F01N 1/02

[52] U.S. Cl. ..... 181/272; 181/273; 440/89

[58] Field of Search ..... 440/89; 60/323; 181/249, 250, 255, 266, 272, 273, 276, 269, 240

[56] References Cited

U.S. PATENT DOCUMENTS

| | | | |
|---|---|---|---|
| 2,017,745 | 10/1935 | Bourne | 181/273 |
| 2,735,396 | 2/1956 | Agar | 440/89 X |
| 3,402,785 | 9/1968 | Powers et al. | 181/250 |
| 3,429,397 | 2/1969 | Case | 181/276 |
| 4,145,988 | 3/1979 | Harada | 440/89 |

*Primary Examiner*—L. T. Hix
*Assistant Examiner*—Thomas H. Tarcza
*Attorney, Agent, or Firm*—Donald D. Mon

[57] ABSTRACT

An exhaust silencer for an outboard engine including an expansion chamber for reducing the exhaust noise. A reflection chamber having an open end and a closed end is placed with its open end communicating with the expansion chamber at a location which is reversely spaced from the open end of an exhaust pipe discharging into the expansion chamber. This enables the engine to be operated optimally in a plurality of engine speed ranges and for the silencer to occupy a minimal volume.

11 Claims, 6 Drawing Figures

EXHAUST SILENCER FOR OUTBOARD ENGINE WITH A REFLECTION CHAMBER

FIELD OF THE INVENTION

The present invention relates to an exhaust device for an outboard engine, for reducing the exhaust noise.

BACKGROUND OF THE INVENTION

In an outboard engine equipped with a two-stroke engine unit, by selecting the exhaust system, especially the capacity and shape of the exhaust expansion chamber thereof or the length of an exhaust pipe protruding into the exhaust expansion chamber, the reflected pressure waves in the exhaust system are exerted upon the exhaust ports so that the engine output and the fuel economy may be improved. In this arrangement, the relationships between the exhaust timing, and the timing at which the reflected pressure waves reach the engine exhaust ports, are substantially determined by the geometrical shape of the exhaust system and by the temperature of the exhaust gases, whereas the intervals between the exhaust gas scavenging timings are varied with variations in the engine speed. Generally speaking, therefore, it is the common practice to design the exhaust system so that the best results are obtained in the vicinity of the normal rpm of the engine.

Since a high rpm range, e.g., at about 5500 rpm is normally used in the outboard engine, the exhaust system is so designed that the best performance can be obtained in such high rpm range. As a result, the output torque in an intermediate rpm range is reduced and a depressed portion is formed in an output torque curve. This undesirably causes deterioration in acceleration, but no counter-measure for effectively solving that problem has been conceived according to the prior art.

The present invention therefore contemplates improvements for such an exhaust device for an outboard engine, which can increase the output torque in an intermediate rpm range without deteriorating the high speed performance it also contemplates doing so in a minimal volume, which is important to an outboard engine installation where space is limited.

BRIEF DESCRIPTION OF THE INVENTION

The invention is carried out in combination with an internal combustion engine having an exhaust port, and an expansion chamber in an exhaust system that extends from the exhaust port. A reflection chamber of predetermined length has an open and a closed end. Its open end opens into the expansion chamber. In accordance with the construction of the present invention, reflected pressure waves having different timings from those generated by the expansion chamber are generated by the reflection chamber so that the output performance can also be improved in the rpm range other than the normal one, by the use of the reflected pressure waves. Although sufficient results can be obtained with the use of only one reflection chamber, a plurality of reflection chambers having different lengths may be provided, if desired to increase the benefits of the invention. The reflection chamber may be so constructed either so that its whole structure is accommodated within the expansion chamber or so that a portion protrudes out of the expansion chamber. Because engine cooling water is discharged into the exhaust system of the outboard engine, the reflection chamber will preferably be formed with a water vent hole. The reflection chamber is not specially limited in its shape and arrangement, so that it can be disposed either in the longitudinal direction of the expansion chamber or along the periphery of the same but its opening will be reversely spaced from the outlet opening of the exhaust pipe that discharges into the expansion chamber.

The above and other features of the invention will be fully understood from the following detailed description and the accompanying drawings, in which:

DETAILED DESCRIPTION OF THE INVENTION

Figure 1:
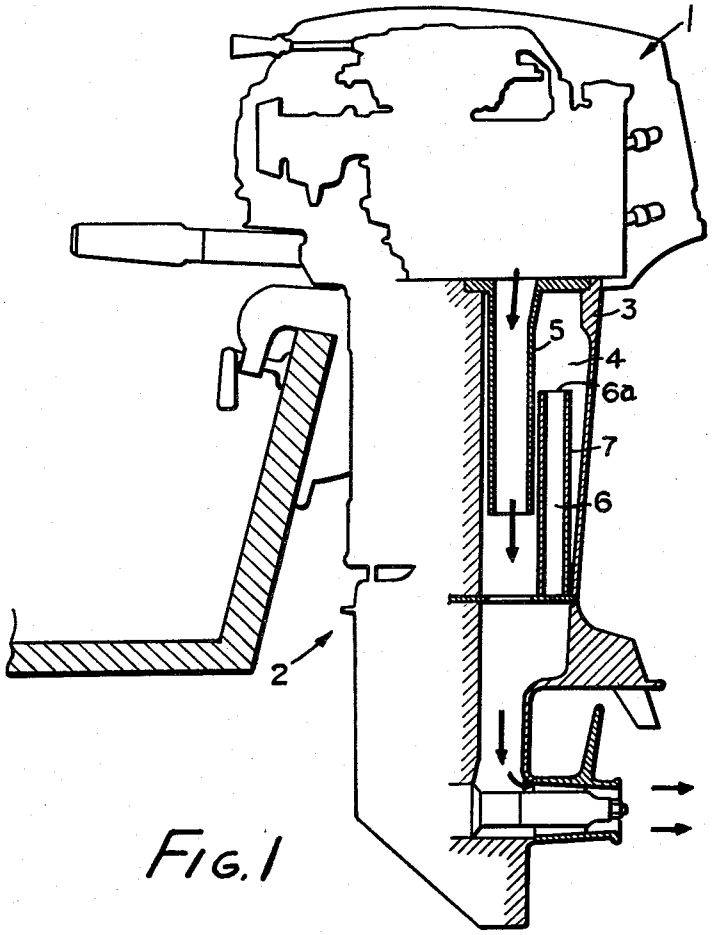
FIG. 1 is a side elevation, partly in schematic notation, and partly in cutaway cross-section, showing the presently-preferred embodiment of the invention.

With reference to FIG. 1, an outboard engine is composed of an engine unit 1 and a propelling unit 2. Its casing 3 is formed with an exhaust expansion chamber 4. An engine exhaust pipe 5 protrudes into the expansion chamber 4 so that the engine exhaust gases are discharged downward from the exhaust pipe 5 through the expansion chamber 4, and there to the outside. Then is disposed in the expansion chamber 4 a reflection chamber 6 which is made of a tubular member 7 with one end 6*a* opened into the expansion chamber 4. Its other end is closed. According to the construction thus far described, the pressure waves of the engine exhaust gases are reflected partly by the walls of the expansion chamber 4 into first reflected waves, which will propagate backward through the exhaust pipe 5 until they reach the exhaust port of the engine unit, and partly by the closed end of the reflection chamber 6 into second reflected waves, which reach the engine exhaust port with a time lag from the first ones. The time lag of the second reflected waves from the first ones is substantially determined by the length of the reflection chamber 6.

Figure 2:
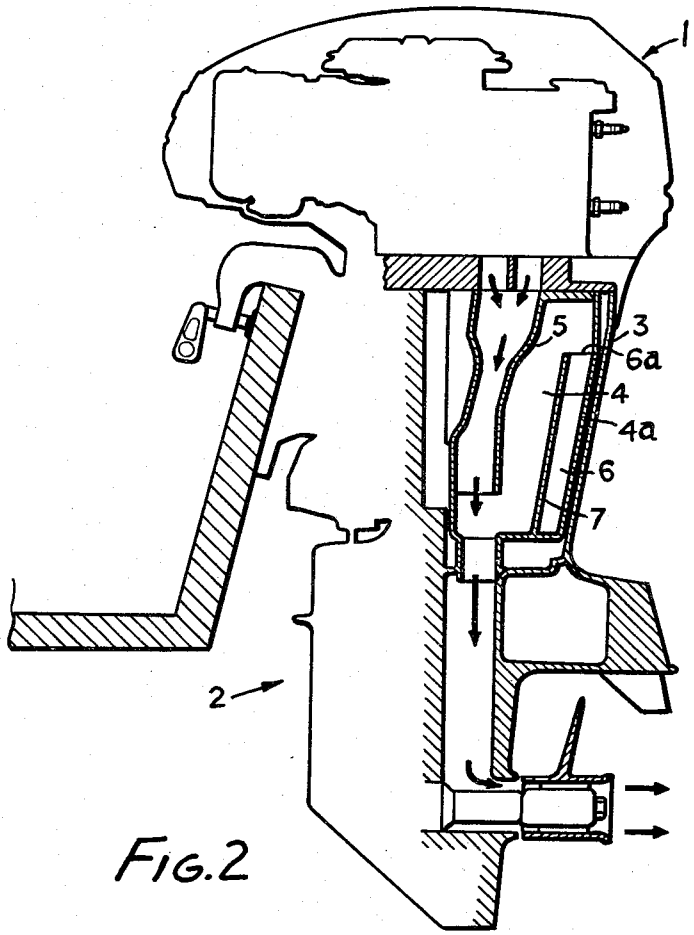
FIG. 2 is a view similar to FIG. 1, showing another embodiment of the invention.
Figure 3:
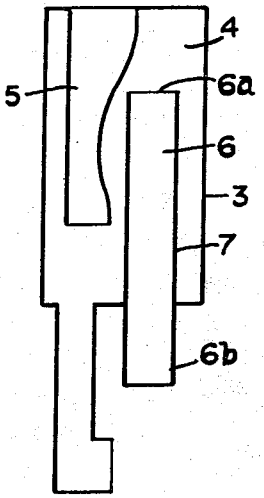
FIG. 3 is a schematic showing of yet another embodiment of the invention.

FIG. 2 shows another embodiment, in which the present invention is applied to the outboard engine of the type having its housing 4*a* made separately of the casing 3 of the propelling unit 2 thereby to form the expansion chamber 4 and accommodated in the casing 3. In this embodiment, the reflection chamber 6 is made up of the housing 4*a* and a partition 7. Incidentally, the reflection chamber 6 may have its closed other end 6*b* protruding out of the expansion chamber 4, as shown in FIG. 3.

Figure 4B:
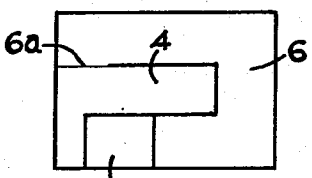
FIGS. 4*a* and 4*b* are schematic views of two forms of still another embodiment of the invention.
Figure 4A:
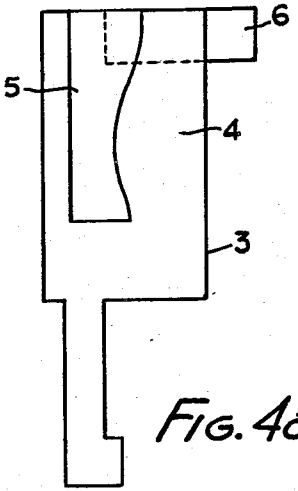

On the other hand, FIGS. 4 (*a*) and (*b*) show two types of another embodiment, in which the reflection chamber 6 is arranged circumferentially instead of longitudinally of the expansion chamber 4 such that its one end 6*a* is opened into the expansion chamber 4 and its other end is closed.

In all of the embodiments, the number of the reflection chambers need not be limited to one but instead a suitable number of reflection chambers having different lengths can be provided.

As can be seen in the drawings, the open end of the reflection chamber is reversely spaced from the outlet end of exhaust pipe 5, and is reversely facing. By this is meant that the opening into the reflection chamber is stepped back relative to the exhaust pipe opening. This creates a space-saving overlap. In the outboard engine as shown, this reverse spacing results in the open end of the reflection chamber's being at an upper position relative to the open end of the exhaust pipe. This overlap shortens the distance from the engine to the bottom of the reflection chamber.

According to the present invention, the pressure waves of the engine exhaust gases are reflected not only by the walls of the expansion chamber, as customary, so that they reach the engine exhaust port as the "first" reflected waves, but also by the reflection chamber so that they reach the engine exhaust port as the "second" reflected waves, out of phase with respect to the first ones. As a result, the reflected pressure waves of the exhaust gases can be made to contribute to the improvement in the engine performance over a relatively wide range of the engine running condition. More specifically, for example, the expansion chamber is so designed that the first reflected pressure waves can contribute to the improvement in the engine performance in the high rpm range which is the normal one in the case of the outboard engine, and the reflection chamber is so designed that the second reflected pressure waves can become effective in the intermediate rpm range.

Figure 5:
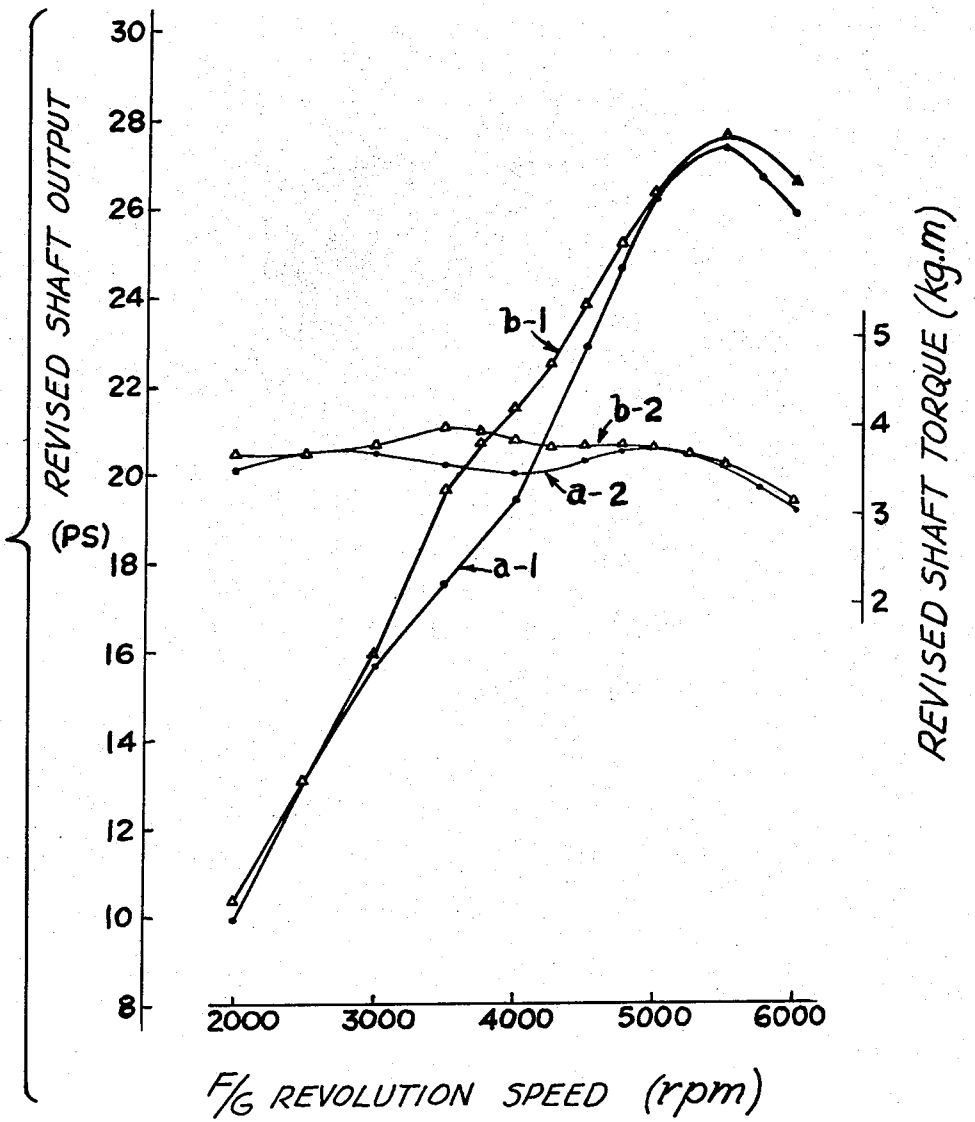
FIG. 5 is a graphical presentation illustrating the benefits obtainable with the use of this invention.

By these designs, the depressed phenomenon in the output torque curve of the outboard engine can be eliminated. FIG. 5 is a graphical presentation showing the curves indicating the shaft output and torque of the outboard engine, to which the present invention is applied. In FIG. 5, curve a-1 indicates the shaft output of the outboard engine according to the prior art, whereas curve a-2 indicates the shaft torque of the same. On the other hand, curve b-1 indicates the shaft output of the outboard engine according to the present invention, whereas curve b-2 indicates the shaft torque of the same. As is quite apparent from those curves, the depressed phenomenon in the engine output can be effectively eliminated with the use of the present invention.

This invention is not to be limited by the embodiments shown in the drawings and described in the description, which are given by way of example and not of limitation, but only in accordance with the scope of the appended claims.

We claim:

1. In an exhaust device for an outboard engine which includes an expansion chamber having communication with the exhaust port of an engine unit for discharging engine exhaust gases therethrough, the improvement comprising a reflection chamber of predetermined length with one end opened into said expansion chamber and its other end closed, an exhaust pipe projecting into said expansion chamber and discharging through an opening end of said exhaust pipe, said open end of said reflection chamber being reversely spaced from said open end of said exhaust pipe, and reversely faced relative thereto.

2. Apparatus according to claim 1 in which a plurality of said reflection chambers of different lengths are provided.

3. Apparatus according to claim 1 in which said reflection chamber is accommodated inside said expansion chamber.

4. Apparatus according to claim 2 in which said reflection chambers are accommodated inside said expansion chamber.

5. Apparatus according to claim 1 in which a portion of said reflection chamber extends outside of said expansion chamber.

6. Apparatus according to claim 2 in which a portion of at least one of said reflection chamber extends outside of said expansion chamber.

7. Apparatus according to claim 1 in which a water vent hole is formed in said reflection chamber.

8. Apparatus according to claim 1 in which said reflection chamber extends peripherally relative to said expansion chamber.

9. Apparatus according to claim 1 in which said reflection chamber extends longitudinally relative to said expansion chamber.

10. Apparatus according to claim 8 in which a plurality of said reflection chambers of different lengths are provided.

11. Apparatus according to claim 9 in which a plurality of said reflection chambers of different lengths are provided.

* * * * *